US007863873B2

(12) United States Patent
Hou et al.

(10) Patent No.: US 7,863,873 B2
(45) Date of Patent: Jan. 4, 2011

(54) POWER MANAGEMENT CIRCUIT AND METHOD OF FREQUENCY COMPENSATION THEREOF

(75) Inventors: Chun-Lin Hou, Hsinchu (TW); Yong-Nien Rao, Hsinchu (TW)

(73) Assignee: Raydium Semiconductor Corporation, Hsinchu (TW)

( * ) Notice: Subject to any disclaimer, the term of this patent is extended or adjusted under 35 U.S.C. 154(b) by 375 days.

(21) Appl. No.: 12/222,812

(22) Filed: Aug. 18, 2008

(65) Prior Publication Data

US 2009/0237048 A1 Sep. 24, 2009

(30) Foreign Application Priority Data

Mar. 19, 2008 (TW) ..... 97109622 A

(51) Int. Cl.
*G05F 1/40* (2006.01)
*G04F 1/56* (2006.01)

(52) U.S. Cl. ..... 323/272; 323/271; 323/273; 323/274; 323/282; 323/280

(58) Field of Classification Search ..... 323/271, 323/272, 273, 274, 282, 280
See application file for complete search history.

(56) References Cited

U.S. PATENT DOCUMENTS 6,373,233 B2 4/2002 Bakker et al.
6,759,836 B1 7/2004 Black, Jr.
6,765,374 B1 7/2004 Yang et al.
7,038,431 B2 5/2006 Benbrik
7,088,082 B2 8/2006 Jung
2004/0021518 A1 * 2/2004 Wrathall ..... 330/253
2006/0192538 A1 * 8/2006 Wang et al. ..... 323/282
2006/0226821 A1 * 10/2006 Whittaker ..... 323/282
2007/0241730 A1 * 10/2007 Dow et al. ..... 323/280
2009/0128110 A1 * 5/2009 DeLurio et al. ..... 323/282

* cited by examiner

*Primary Examiner*—Bao Q Vu
(74) *Attorney, Agent, or Firm*—Bacon & Thomas, PLLC

(57) ABSTRACT

A power management circuit includes a regulator circuit, a first frequency compensation circuit, a first switch circuit and a detection circuit. The regulator circuit includes a signal output end. The first switch circuit is turned on in response to an enabled first control signal such that the first frequency compensation circuit is coupled to the regulator circuit. The detection circuit determines whether an output capacitor is coupled to the signal output end, and generates the enabled first control signal to turn on the first switch circuit and connect the first frequency compensation circuit to the regulator circuit when the output capacitor is not coupled to the signal output end. Therefore, the regulator circuit is frequency compensated by the first frequency compensation circuit.

16 Claims, 5 Drawing Sheets

FIG. 5A
FIG. 5B
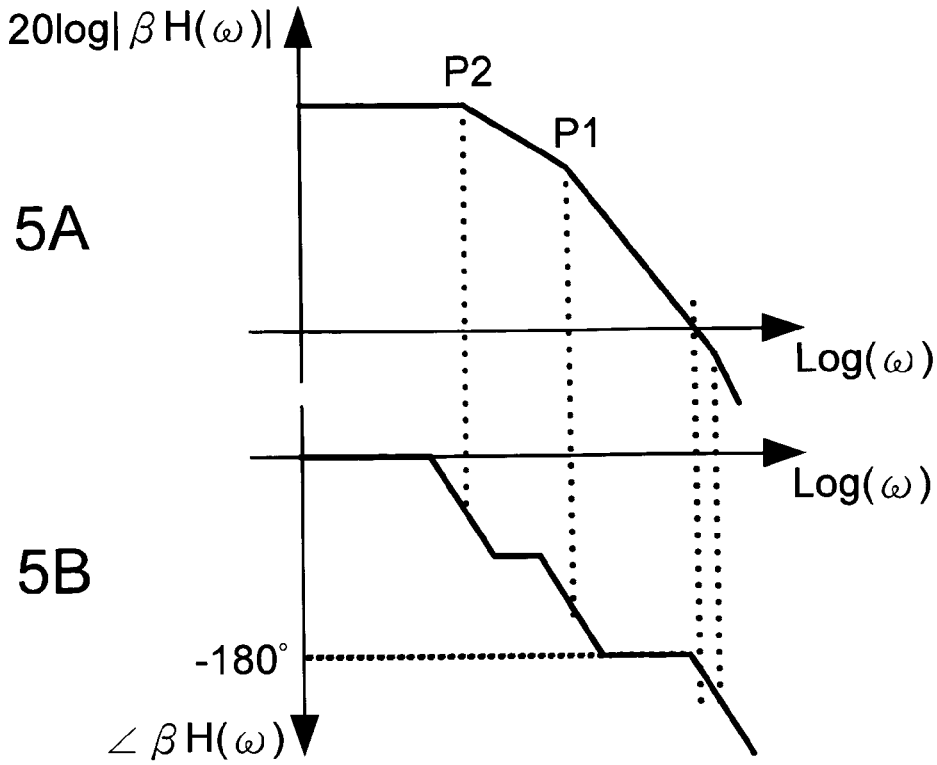
FIG. 6A
FIG. 6B
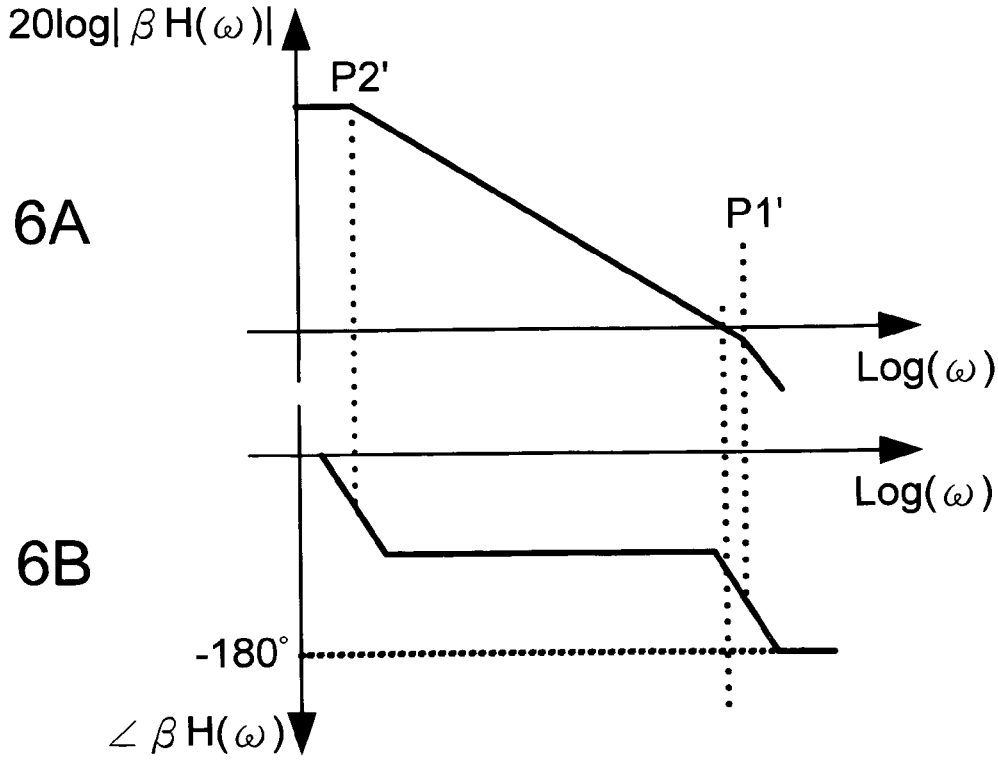

FIG. 9A
FIG. 9B
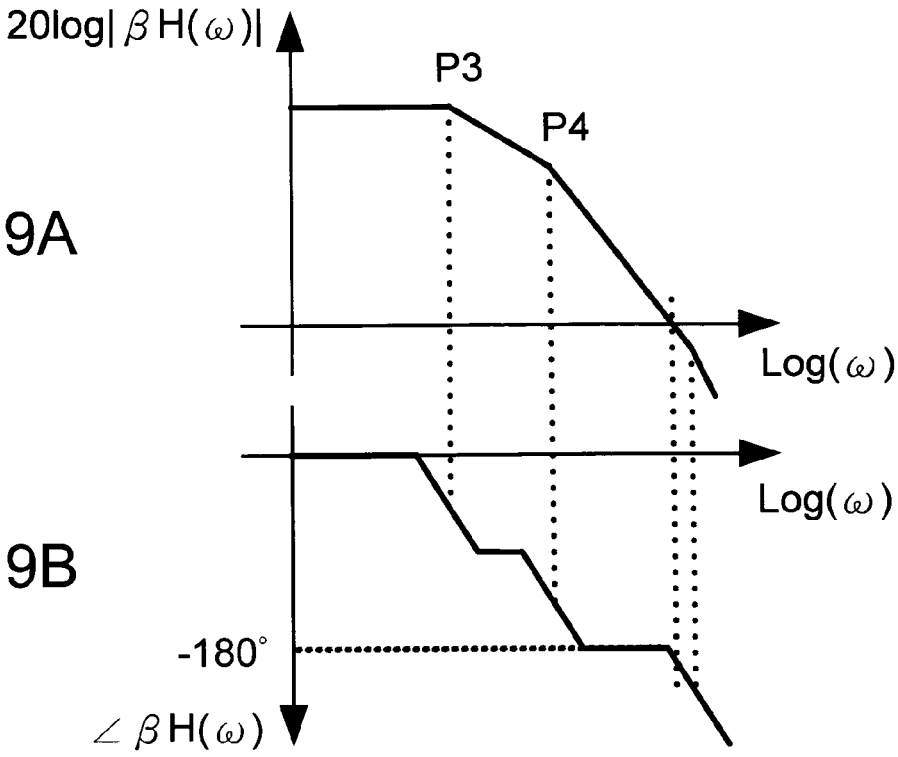
FIG. 10A
FIG. 10B
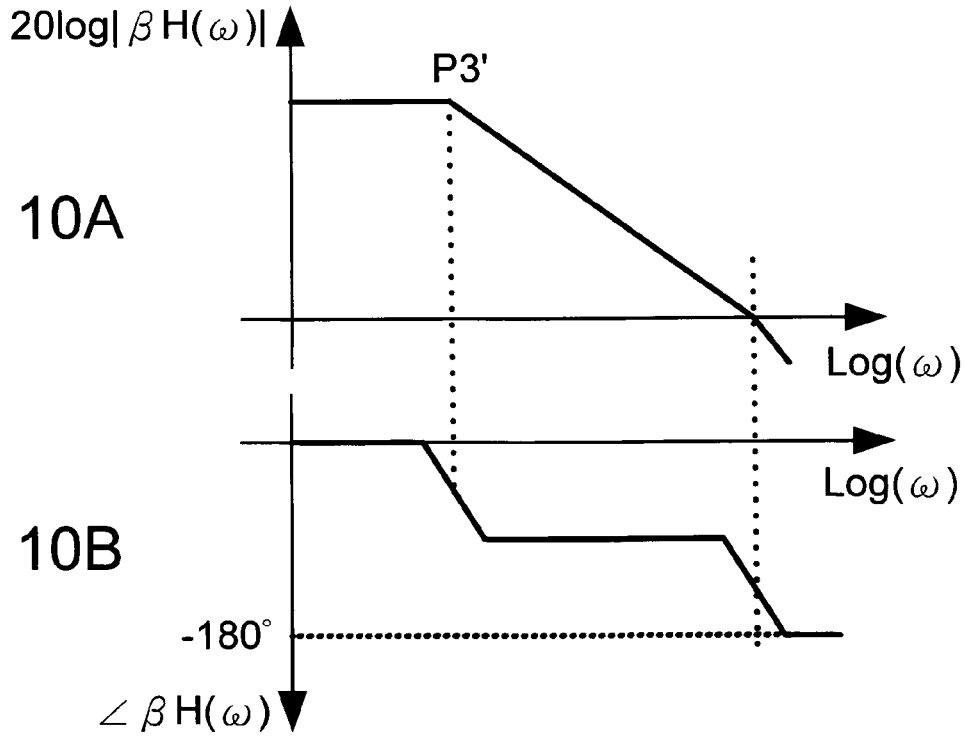

POWER MANAGEMENT CIRCUIT AND METHOD OF FREQUENCY COMPENSATION THEREOF

This application claims the benefit of Taiwan application Serial No. 97109622, filed Mar. 19, 2008, the subject matter of which is incorporated herein by reference.

BACKGROUND OF THE INVENTION

1. Field of the Invention

The invention relates in general to a voltage stabilizer circuit, and more particularly to a voltage stabilizer circuit applied to a power management system.

2. Description of the Related Art

Conventionally, low dropout voltage (LDO) regulator circuits are applied to various power management systems, such as a battery system of a handheld electronic device. FIG. 1 is a circuit diagram showing a conventional low dropout voltage (LDO) stabilizer 10. Referring to FIG. 1, for example, the LDO stabilizer 10 includes an error operational amplifier OP1, a transistor T1, and resistors R1 and R2, wherein the negative input end of the error operational amplifier OP1 receives a reference voltage Vrf. The transistor T1 and the resistors R1 and R2 constitute a feedback circuit for feeding an output voltage Vx of the error operational amplifier OP1 back to the positive input end of the error operational amplifier OP1 so that a feedback voltage substantially approaching the level of the reference voltage Vrf can be provided.

Conventionally, a high-capacitance load capacitor CL and an equivalent series resistor (ESR) RL have to be disposed at the output end of the LDO stabilizer 10 so that the LDO stabilizer 10 can operate stably. However, the load capacitor CL is implemented by a larger integrated circuit (IC) area or a discrete element. Thus, the conventional LDO stabilizer 10 has the drawback of the larger circuit area and the higher manufacturing cost. If the load capacitor CL is omitted, the LDO stabilizer 10 cannot operate stably.

SUMMARY OF THE INVENTION

The invention is directed to a power management circuit, which can operate stably without a load capacitor. Thus, compared with the conventional low dropout voltage (LDO) stabilizer, the power management circuit of the embodiment has the advantages of the higher operation stability, the smaller area, the lower cost and the higher flexibility in the circuit design.

According to a first aspect of the present invention, a power management circuit is provided. The power management circuit includes a regulator circuit, a first frequency compensation circuit, a first switch circuit and a detection circuit. The regulator circuit includes a signal output end. The first switch circuit is turned on in response to an enabled first control signal to couple the first frequency compensation circuit to the regulator circuit. The detection circuit determines whether an output capacitor is coupled to the signal output end, and generates the enabled first control signal to turn on the first switch circuit and thus to connect the first frequency compensation circuit to the regulator circuit when the output capacitor is not coupled to the signal output end. Therefore, the regulator circuit is frequency compensated.

According to a second aspect of the present invention, a method of frequency compensating a regulator circuit comprising a signal output end is provided. The method includes the following steps. First, it is determined whether an output capacitor is coupled to the signal output end. Second, when the output capacitor is not coupled to the signal output end, a first frequency compensation circuit is connected to the regulator circuit such that the regulator circuit is frequency compensated.

The invention will become apparent from the following detailed description of the preferred but non-limiting embodiments. The following description is made with reference to the accompanying drawings.

BRIEF DESCRIPTION OF THE DRAWINGS

FIGS. 5A and 5B respectively show a gain Bode plot and a phase Bode plot of a loop gain of a regulator circuit 22 when the compensation is not performed.

FIGS. 6A and 6B respectively show the gain Bode plot and the phase Bode plot of the loop gain of the regulator circuit 22 after the compensation is performed.

FIGS. 9A and 9B respectively show a gain Bode plot and a phase Bode plot of a loop gain of a regulator circuit 42 when the frequency compensation is not performed.

FIGS. 10A and 10B respectively show the gain Bode plot and the phase Bode plot of the loop gain of the regulator circuit 42 after the frequency compensation is performed.

DETAILED DESCRIPTION OF THE INVENTION

A power management circuit of this embodiment is to provide a detection circuit to determine whether a high-capacitance output capacitor and an equivalent series resistor (ESR) are coupled to an output end of the power management circuit, and thus to select a corresponding frequency compensation circuit to frequency compensate a regulator circuit in the power management circuit.

Figure 1:
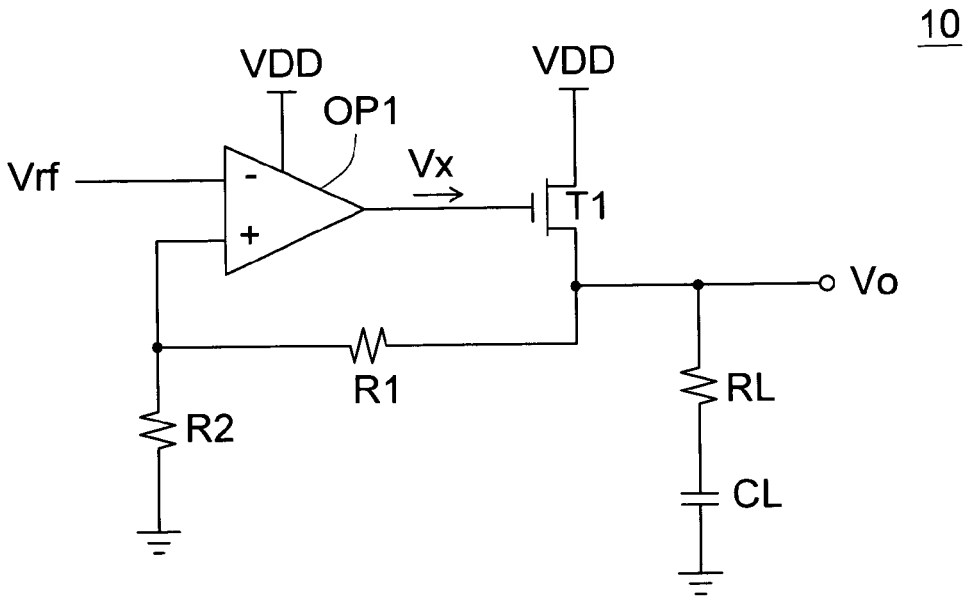
FIG. 1(PRIOR ART)
FIG. 1 (Prior Art) is a circuit diagram showing a conventional low dropout voltage stabilizer.
Figure 2:
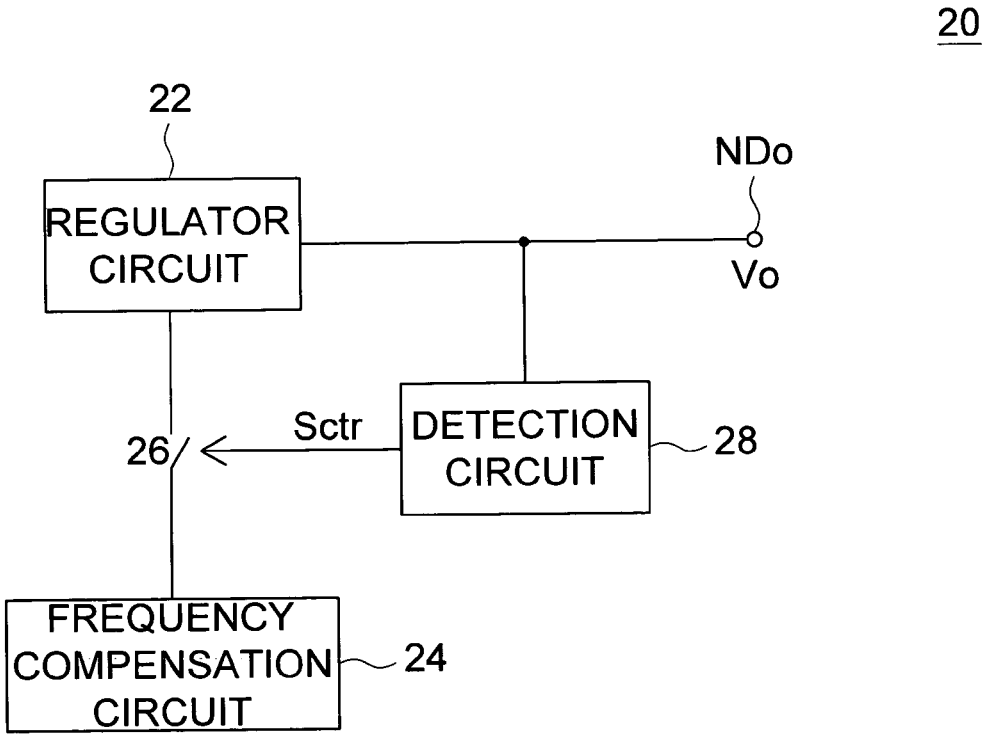
FIG. 2 is a block diagram showing a power management circuit according to the embodiment of the invention.

FIG. 2 is a block diagram showing a power management circuit 20 according to the embodiment of the invention. Referring to FIG. 2, the power management circuit 20 includes a regulator circuit 22, a frequency compensation circuit 24, a switch circuit 26 and a detection circuit 28. The switch circuit 26 has first and second output ends respectively coupled to the regulator circuit 22 and the frequency compensation circuit 24. The switch circuit 26 is further turned on in response to a control signal Sctr to couple the frequency compensation circuit 24 to the regulator circuit 22.

The regulator circuit 22 has a signal output end NDo for providing an output voltage Vo. The detection circuit 28 determines whether a high-capacitance output capacitor and an ESR are coupled to the signal output end NDo, and generates an enabled control signal Sctr to turn on the switch circuit 26 in order to connect the frequency compensation circuit 24 to the regulator circuit 22 such that the regulator circuit 22 is frequency compensated when no high-capacitance output capacitor and no ESR are coupled to the signal output end NDo. For example, the high-capacitance output capacitor has the capacitance greater than or equal to 1 micro farad (μF).

Figure 3:
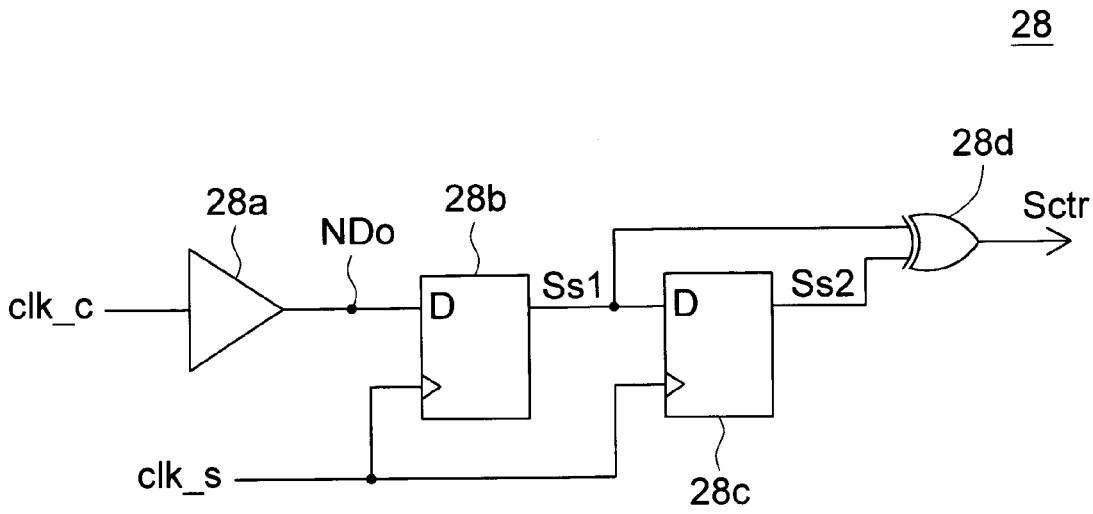
FIG. 3 is a detailed circuit diagram showing a detection circuit 28 of FIG. 2.

FIG. 3 is a detailed circuit diagram showing the detection circuit 28 of FIG. 2. More specifically speaking, the detection circuit 28 includes an input buffer 28*a*, flip flops 28*b* and 28*c* and a logic unit 28*d*. The input buffer 28*a* includes an input end for receiving a charge clock signal clk_c, and an output end coupled to the signal output end NDo. The input buffer 28*a* provides the charge clock signal clk_c to the signal output end NDo to charge the capacitor on the signal output end NDo.

When no high-capacitance output capacitor and no ESR are coupled to the signal output end NDo, the value of the equivalent capacitor viewed from the signal output end NDo is lower. At this time, the signal level on the signal output end NDo is substantially switched between a high level and a low level with the fluctuation of the charge clock signal clk_c. When the high-capacitance output capacitor and the ESR are coupled to the signal output end NDo, the value of the equivalent capacitor viewed from the signal output end NDo is higher. At this time, the rate of signal level fluctuation on the signal output end NDo is slower.

The flip flop 28*b* samples the signal on the signal output end NDo to generate a sampling signal Ss1 in response to a sampling clock signal clk_s. The flip flop 28*c* samples the sampling signal Ss1 to generate a sampling signal Ss2 in response to the sampling clock signal clk_s. When no high-capacitance output capacitor and no ESR are coupled to the signal output end NDo, the signal on the signal output end NDo is switched between the high level and the low level. Thus, the sampling signals Ss1 and Ss2 obtained by the sampling of the flip flops 28*b* and 28*c* have different values. For example, the sampling signals Ss1 and Ss2 are respectively equal to the value 1 and the value 0 at the same time instant. When the high-capacitance output capacitor and the ESR are coupled to the signal output end NDo, the signal of the signal output end NDo usually approaches the low level. Thus, the sampling signals Ss1 and Ss2 obtained by the sampling of the flip flops 28*b* and 28*c* have the same value. For example, the sampling signals Ss1 and Ss2 are equal to the value 0 at the same time instant.

The logic circuit 28*d* generates the control signal Sctr in response to the values of the sampling signals Ss1 and Ss2. For example, the logic circuit 28*d* is an exclusive OR (XOR) logic gate for determining that no high-capacitance output capacitor and no ESR are coupled to the signal output end NDo and generating a high-level control signal Sctr to turn on the switch circuit 26 to frequency compensate the regulator circuit 22 when the sampling signals Ss1 and Ss2 have different values. When the sampling signals Ss1 and Ss2 have the same value, the logic circuit 28*d* determines that the high-capacitance output capacitor and the ESR are coupled to the signal output end NDo, and the logic circuit 28*d* generates the disabled control signal Sctr to turn off the switch circuit 26.

Figure 4:
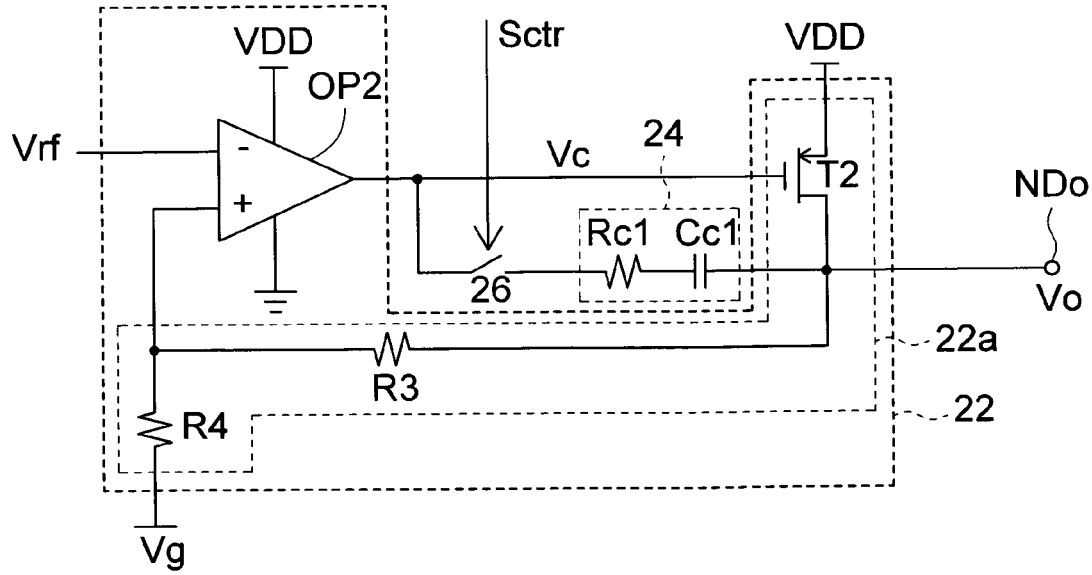
FIG. 4 is a partially detailed circuit diagram showing the power management circuit of FIG. 2.

The regulator circuit 22 of this embodiment will be further described in the following. FIG. 4 is a partially detailed circuit diagram showing the power management circuit of FIG. 2. As shown in FIG. 4, the regulator circuit 22 is a low dropout voltage (LDO) stabilizer, which includes an error operational amplifier OP2 and a feedback circuit 22*a*. The negative input end of the error operational amplifier OP2 receives a reference voltage Vrf, and the positive input end and the output end of the error operational amplifier OP2 are respectively coupled to two ends of the feedback circuit 22*a*. The error operational amplifier OP2 compares the signal inputted through the positive input end with the signal inputted through the negative input end to correspondingly generate an output voltage Vc.

The feedback circuit 22*a* includes a transistor T2 and resistors R3 and R4. First ends of the resistors R3 and R4 are simultaneously coupled to the positive input end of the error operational amplifier OP2, a second end of the resistor R3 is coupled to the signal output end NDo, and a second end of the resistor R4 receives a grounding voltage Vg. For example, the transistor T2 is a P-type metal oxide semiconductor (PMOS) transistor having a source for receiving a high circuit voltage VDD, a gate coupled to the output end of the error operational amplifier OP2, and a drain coupled to the signal output end NDo.

For example, the transistor T2 is biased as a common source amplifier to operate and obtain the output voltage Vo according to a comparison voltage Vc. For example, the resistors R3 and R4 form a bias resistor string for dividing the output voltage Vo and thus providing a divided voltage to the positive input end of the error operational amplifier OP2. Therefore, the output voltage Vo is fed back to the positive input end of the error operational amplifier OP2.

Generally speaking, when no high-capacitance output capacitor and no ESR are coupled to the signal output end NDo, the regulator circuit 22 has poles P1 and P2, wherein the poles P2 and P1 are frequency response poles respectively formed by the equivalent capacitor inductors viewed from the output end of the error operational amplifier OP2 and the output end of the regulator circuit 22. In addition, P2 is a primary pole and P1 is a secondary pole, as shown in FIGS. 5A and 5B. FIGS. 5A and 5B respectively show a gain Bode plot and a phase Bode plot of a loop gain of the regulator circuit 22 when the frequency compensation is not performed. As shown in FIGS. 5A and 5B, the phase corresponding to the frequency of the unit gain equal to the loop gain of the regulator circuit 22 (i.e., the loop gain is equal to 0 dB) approaches −180 degrees so that the regulator circuit 22 generates the oscillation.

In order to prevent the regulator circuit 22 from generating the oscillation, the switch circuit 26 is turned on to couple the frequency compensation circuit 24 to the regulator circuit 22 so that the regulator circuit 22 can be frequency compensated when the detection circuit 28 detects that no high-capacitance output capacitor and no ESR are coupled to the signal output end NDo. The frequency compensation circuit 24 of this embodiment includes a resistor Rc1 and a capacitor Cc1. The resistor Rc1, the capacitor Cc1 and the switch circuit 26 are serially connected to and between the error operational amplifier OP2 and the signal output end NDo. When the switch circuit 26 is turned on, the frequency compensation circuit 24 and the regulator circuit 22 form a loop so that the frequency compensation circuit 24 can frequency compensate the regulator circuit 22.

For example, FIGS. 6A and 6B respectively show the gain Bode plot and the phase Bode plot of the loop gain of the regulator circuit 22 after the compensation is performed. In order to make the regulator circuit 22 operate stably, the regulator circuit 22 is compensated by way of pole splitting in this embodiment so that the poles P1 and P2 respectively fluctuate to P1' and P2'. Consequently, it is possible to ensure that the regulator circuit 22 has the higher phase margin and that the regulator circuit 22 can operate stably.

Figure 7:
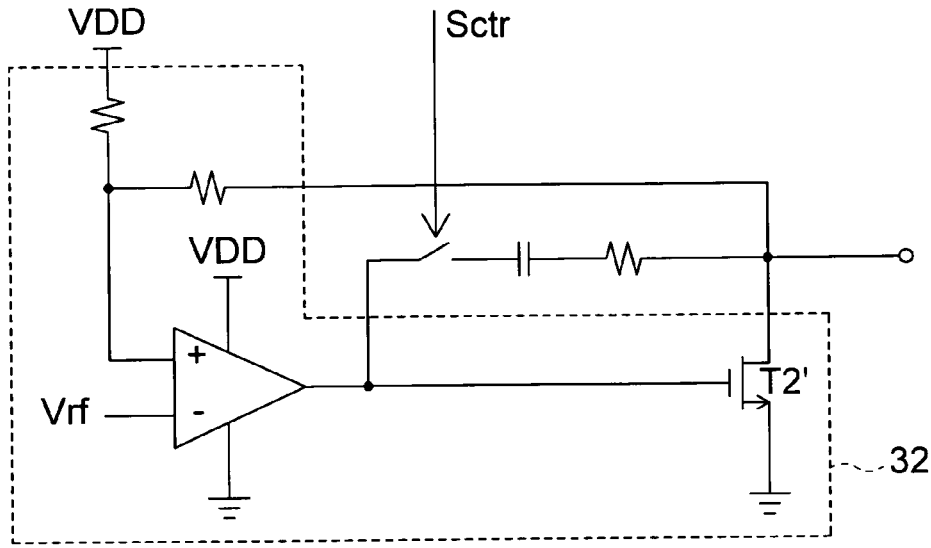
FIG. 7 is another block diagram showing the power management circuit according to the embodiment of the invention.

In this embodiment, the transistor T2 in the regulator circuit 22 is a PMOS transistor. However, the regulator circuit 22 of this embodiment is not limited to the PMOS transistor. For example, another regulator circuit 32 of this embodiment may also be implemented by an NMOS transistor T2', as shown in FIG. 7.

Figure 8:
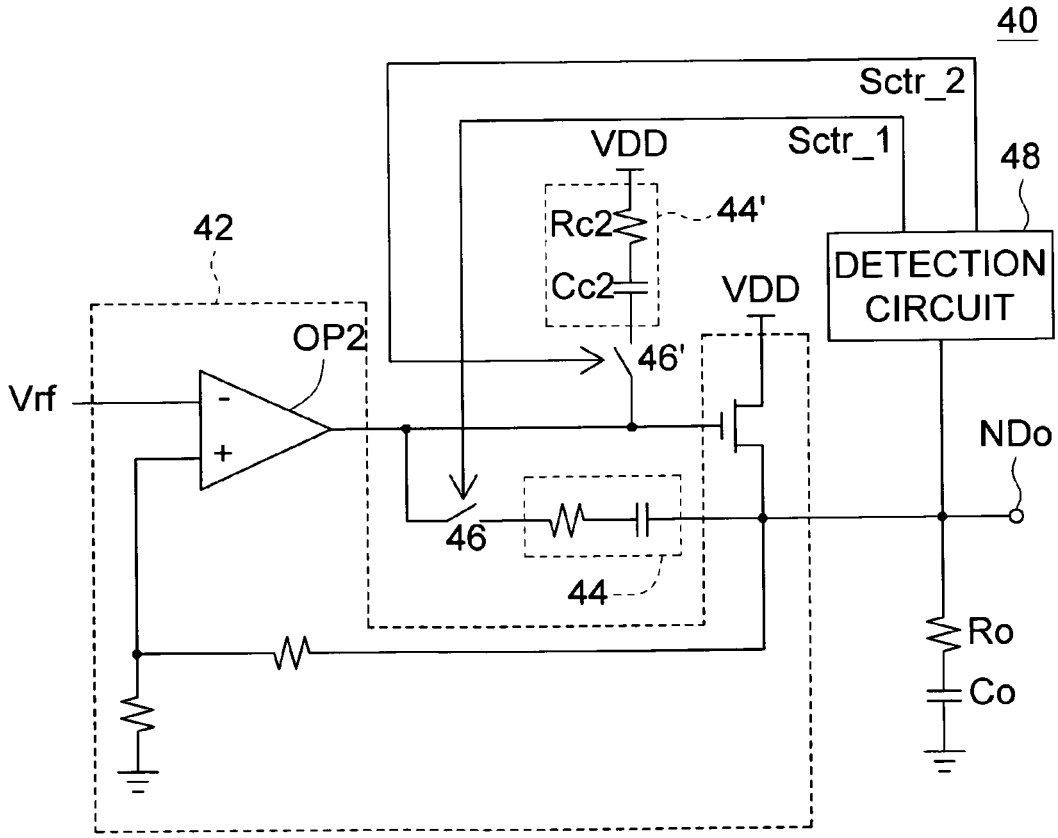
FIG. 8 is still another block diagram showing the power management circuit according to the embodiment of the invention.

In this illustrated embodiment, only one frequency compensation circuit 24 is disposed in the power management circuit 20 so that the regulator circuit 22 can be frequency compensated when no high-capacitance output capacitor and no ESR are coupled to the signal output end NDo. However, the power management circuit 20 of this embodiment is not particularly restricted to the inclusion of only one frequency compensation circuit. For example, another power management circuit 40 of this embodiment includes two frequency compensation circuits 44 and 44', coupled to the regulator circuit 42 through the turned-on switches 46 and 46', respectively, to frequency compensate the regulator circuit 42 when no high-capacitance output capacitor and no ESR are coupled to the signal output end NDo and the high-capacitance output capacitor and the ESR are coupled to the signal output end NDo, as shown in FIG. 8.

The frequency compensation circuits 44 and 24 have similar structures, and the frequency compensation circuit 44' includes a resistor Rc2 and a capacitor Cc2. First ends of the resistor Rc2 and the capacitor Cc2 are connected together, a second end of the resistor Rc2 receives the high circuit voltage VDD, and a second end of the capacitor Cc2 is coupled to the switch 46'. A detection circuit 48 generates enabled control signals Sctr_1 and Sctr_2 when no high-capacitance output capacitor and no ESR are coupled to the signal output end NDo and when the high-capacitance output capacitor and the ESR are coupled to the signal output end NDo, respectively. In one example, as compared to the control signal Sctr generated by the detection circuit 28, the control signals Sctr_1 and Sctr_2 are used for controlling the frequency compensation circuits 44 and 44' through the switches 46 and 46' respectively, and the control signal Sctr_2 is an inverse signal of the control signal Sctr_1.

Illustrations will be made by taking the operation of the frequency compensation circuit 44' as an example. FIGS. 9A and 9B respectively show a gain Bode plot and a phase Bode plot of a loop gain of a regulator circuit 42 when the frequency compensation is not performed. Generally speaking, when the high-capacitance output capacitor Co and the ESR Ro are coupled to the signal output end NDo, the regulator circuit 42 has poles P3 and P4, wherein the poles P4 and P3 are frequency response poles respectively formed by the equivalent capacitor inductors viewed from the output end of the error operational amplifier OP2 and the output end of the regulator circuit 42. The pole P3 is a primary pole and the pole P4 is a secondary pole owing to the high-capacitance output capacitor Co. As shown in FIGS. 9A and 9B, the phase corresponding to the frequency of the unit gain equal to the loop gain of the regulator circuit 42 approaches −180 degrees so that the regulator circuit 42 generates the oscillation.

In order to prevent the regulator circuit 42 from generating the oscillation, when the detection circuit 48 detects that the high-capacitance output capacitor Co and the ESR Ro are coupled to the signal output end NDo, the turned-on switch 46' couples the frequency compensation circuit 44' to the regulator circuit 42 in order to frequency compensate the regulator circuit 42. For example, FIGS. 10A and 10B respectively show the gain Bode plot and the phase Bode plot of the loop gain of the regulator circuit 42 after the frequency compensation is performed. In order to make the regulator circuit 42 operate stably, the regulator circuit 42 is compensated by way of pole-zero cancellation. Consequently, it is possible to ensure that the regulator circuit 42 has the higher phase margin and that the regulator circuit 42 can operate stably.

The power management circuit of this embodiment is provided with the detection circuit to determine whether the high-capacitance output capacitor and the ESR are coupled to the output end of the power management circuit, and thus to select the corresponding frequency compensation circuit to frequency compensate the regulator circuit of the power management circuit. Thus, the power management circuit of this embodiment can operate stably without the load capacitor. Compared with the conventional low dropout voltage (LDO) stabilizer, the power management circuit of this embodiment has the advantages of higher operation stability, smaller area, lower cost and higher flexibility in the circuit design.

In addition, the power management circuit of this embodiment may further include two or more than two frequency compensation circuits for frequency compensating the regulator circuit when the high-capacitance output capacitor and the ESR are coupled to the output end of the power management circuit and when no high-capacitance output capacitor and no ESR are coupled to the output end of the power management circuit, respectively. Thus, the power management circuit of this embodiment has the better frequency response property.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A power management circuit, comprising:

a regulator circuit comprising a signal output end;

a first frequency compensation circuit;

a first switch circuit, electrically connected to and between the regulator circuit and the first frequency compensation circuit; and a detection circuit for determining whether an output capacitor is coupled to the signal output end, wherein when the detection circuit determines that the output capacitor is not coupled to the signal output end, the detection circuit generates an enabled first control signal and outputs the enabled first control signal to the first switch circuit to turn on the first switch circuit such that the first frequency compensation circuit is electrically connected to the regulator circuit and the regulator circuit is frequency compensated.

2. The power management circuit according to claim 1, wherein the detection circuit comprises:

an input buffer comprising an input end for receiving a charge clock signal, and an output end coupled to the signal output end, wherein the input buffer provides the charge clock signal to the signal output end;

a first flip flop for sampling a signal on the signal output end to generate a first sampling signal in response to a sampling clock signal;

a second flip flop for sampling the first sampling signal to generate a second sampling signal in response to the sampling clock signal; and a logic circuit for determining that the output capacitor is not coupled to the signal output end and generating the enabled first control signal when the first sampling signal and the second sampling signal have substantially different levels.

3. The power management circuit according to claim 2, wherein the logic circuit determines that the output capacitor is coupled to the signal output end when the first sampling signal and the second sampling signal have substantially the same level.

4. The power management circuit according to claim 1, wherein the regulator circuit comprises:

an error operational amplifier having a negative input end for receiving a reference voltage; and a feedback circuit for feeding an output signal of the error operational amplifier to a positive input end of the error operational amplifier.

5. The power management circuit according to claim 4, wherein the feedback circuit comprises:

a transistor having a source for receiving a first voltage, a gate coupled to an output end of the error operational amplifier, and a drain coupled to the signal output end; and a first resistor and a second resistor, wherein two ends of the first resistor are respectively coupled to the positive input end of the error operational amplifier and a first node and for receiving a second voltage, and two ends of the second resistor are respectively coupled to the positive input end of the error operational amplifier and the signal output end.

6. The power management circuit according to claim 5, wherein the first and second voltages are respectively a high circuit voltage and a grounding voltage, and the transistor is a P-type metal oxide semiconductor (PMOS) transistor.

7. The power management circuit according to claim 5, wherein the first and second voltages are respectively a grounding voltage and a high circuit voltage, and the transistor is an N-type metal oxidation semiconductor (NMOS) transistor.

8. The power management circuit according to claim 5, wherein when the first switch circuit is turned on, the first switch circuit couples a first end and a second end of the first frequency compensation circuit to an output end of the error operational amplifier and a drain of the transistor, respectively.

9. The power management circuit according to claim 4, further comprising:

a second frequency compensation circuit; and a second switch circuit, which is turned on in response to an enabled second control signal to couple the second frequency compensation circuit to the regulator circuit, wherein when the output capacitor is coupled to the signal output end, the detection circuit further generates the enabled second control signal to turn on the second switch circuit to connect the second frequency compensation circuit to the regulator circuit such that the regulator circuit is frequency compensated.

10. The power management circuit according to claim 9, wherein when the second switch circuit is turned on, the second switch circuit further couples the second frequency compensation circuit to an output end of the error operational amplifier.

11. The power management circuit according to claim 1, further comprising:

a second frequency compensation circuit; and a second switch circuit, which is turned on in response to an enabled second control signal to couple the second frequency compensation circuit to the regulator circuit, wherein when the output capacitor is coupled to the signal output end, the detection circuit further generates the enabled second control signal to turn on the second switch circuit to connect the second frequency compensation circuit to the regulator circuit such that the regulator circuit is frequency compensated.

12. The power management circuit according to claim 11, wherein the second frequency compensation circuit comprises a resistor-capacitor series circuit having one end for receiving a specific voltage and the other end coupled to the second switch circuit.

13. The power management circuit according to claim 1, wherein the first frequency compensation circuit comprises a resistor-capacitor series circuit having one end coupled to the first switch circuit and the other end coupled to the signal output end.

14. The power management circuit according to claim 1, wherein the regulator circuit is a low dropout voltage (LDO) regulator circuit.

15. A method of frequency compensating a regulator circuit comprising a signal output end, the method comprising:

determining whether a capacitance of an equivalent capacitor of the signal output end is smaller than a predetermined value; and providing a first frequency compensation frequency to the regulator circuit to frequency compensate the regulator circuit when the capacitance of the equivalent capacitor is smaller than the predetermined value.

16. The method according to claim 15, further comprising:

connecting a second frequency compensation circuit to the regulator circuit to frequency compensate the regulator circuit when the capacitance of the equivalent capacitor is greater than the predetermined value.

* * * * *